US006818119B2

(12) United States Patent
Wang et al.

(10) Patent No.: US 6,818,119 B2
(45) Date of Patent: Nov. 16, 2004

(54) METHOD FOR PROCESSING METALS

(75) Inventors: Guangxin Wang, Wexford, PA (US); Daniel M. Hydock, Lower Burrell, PA (US); John Lehman, Ellwood City, PA (US)

(73) Assignee: Honeywell International Inc., Morristown, NJ (US)

( * ) Notice: Subject to any disclaimer, the term of this patent is extended or adjusted under 35 U.S.C. 154(b) by 217 days.

(21) Appl. No.: 10/172,695

(22) Filed: Jun. 14, 2002

(65) Prior Publication Data

US 2002/0189953 A1 Dec. 19, 2002

Related U.S. Application Data

(62) Division of application No. 09/608,709, filed on Jun. 30, 2000.

(51) Int. Cl.[7] ..... C25C 1/00; C25C 1/06
(52) U.S. Cl. ..... 205/560; 205/587
(58) Field of Search ..... 205/560–579, 205/587

(56) References Cited

U.S. PATENT DOCUMENTS

| | | | | |
|---|---|---|---|---|
| 3,091,022 A | | 5/1963 | Faulkner | |
| 3,787,301 A | | 1/1974 | Bozec et al. | |
| 3,795,595 A | | 3/1974 | Wilson | |
| 3,839,168 A | | 10/1974 | Gandon et al. | |
| 3,871,978 A | | 3/1975 | Gandon et al. | |
| 3,883,411 A | * | 5/1975 | Gendron et al. | 205/588 |
| 3,884,681 A | | 5/1975 | Gandon et al. | |
| 4,039,403 A | | 8/1977 | Astley et al. | |
| 4,040,914 A | * | 8/1977 | Nidola et al. | 205/76 |
| 4,151,050 A | | 4/1979 | Kastening et al. | |
| 4,330,377 A | * | 5/1982 | Franks, Jr. | 205/496 |
| 4,374,008 A | | 2/1983 | Natansohn et al. | |
| 4,525,259 A | | 6/1985 | Horn et al. | |
| 4,832,810 A | | 5/1989 | Nakamura et al. | |
| 4,909,913 A | | 3/1990 | Fukuda et al. | |
| 4,948,476 A | | 8/1990 | Kamperman et al. | |
| 4,948,489 A | | 8/1990 | Greenberg | |
| 5,112,468 A | | 5/1992 | Weigert et al. | |

(List continued on next page.)

FOREIGN PATENT DOCUMENTS

| | | |
|---|---|---|
| EP | 0252478 A2 | 1/1988 |
| EP | 0799905 A1 | 3/1997 |
| JP | 66030549 | 3/1988 |
| JP | 1992000357366 | 12/1992 |
| JP | 1992000357367 | 12/1992 |
| JP | 1993000001673 | 6/1993 |
| JP | 1995000080830 | 3/1995 |
| JP | 1995000080831 | 3/1995 |
| JP | 1996000060362 | 2/1996 |
| JP | 09272970 A | 10/1997 |
| WO | PCT/US 01/ 19255 | 6/2001 |
| WO | WO 02/12577 A1 | 2/2002 |

OTHER PUBLICATIONS

Abstract: Gindin, L. et al., "Extraction—Electrolytic Method of Production of Very Pure Cobalt", Tsvetnye Metal, 34 (No. 12), 1961, pp. 22–26, (no month).

(List continued on next page.)

*Primary Examiner*—Donald R. Valentine
(74) *Attorney, Agent, or Firm*—Wells St. John P.S.

(57) ABSTRACT

The invention encompasses a method and apparatus for producing high-purity metals (such as, for example, high-purity cobalt), and also encompasses the high-purity metals so produced. The method can comprise a combination of electrolysis and ion exchange followed by melting to produce cobalt of a desired purity. The method can result in the production of high-purity cobalt comprising total metallic impurities of less than 50 ppm. Individual elemental impurities of the produced cobalt can be follows: Na and K less than 0.5 ppm each, Fe less than 10 ppm, Ni less than 5 ppm, Cr less than 1 ppm, Ti less than 3 ppm and 0 less than 450 ppm.

17 Claims, 2 Drawing Sheets

U.S. PATENT DOCUMENTS

| | | | |
|---|---|---|---|
| 5,262,019 | A | 11/1993 | Snyder et al. |
| 5,282,946 | A | 2/1994 | Kinoshita et al. |
| 5,306,400 | A | 4/1994 | Bradbury et al. |
| 5,412,967 | A | 5/1995 | Ishihara |
| 5,667,665 | A | 9/1997 | Shindo et al. |
| 5,810,983 | A | 9/1998 | Shindo et al. |
| 6,176,944 | B1 | 1/2001 | Snowman et al. |
| 6,391,172 | B2 | 5/2002 | Cole et al. |

OTHER PUBLICATIONS

Abstract: Krajewski, W. et al., "Electrolytic Cobalt Refining", Erzmetall, 22 (4), 1969, pp. 184–188, (no month).

Boarahla, M. et al., "Metallurgical Chemistry: Obtaining a High–Purity Cobalt from an Industrial Metal", Comples Rendus, (no date).

U. Admon et al., "Microstructure of Electrodeposited Cobalt–Tungsten Thin Films", database HCA on STN, AN 105:28215, EJ. Appl. Phys. (1986) 59(6), 2002–9, abstract, 1 page, (no month).

"Separation of Nickel From Cobalt In Sulphate Medium by Ion Exchange" by L. Rosato, G.B. Harris and R.W. Stanley; paper presented at the 11$^{th}$ AIME Annual Meeting, Dallas Texas: Feb. 14–18, 1982.

"Selective Absorption of Copper, Nickel, Cobalt, and Other Transition Metal Ions From Sulfuric Acid Solutions With The Chelating Ion Exchange Resin XFS 4195" by Robert R. Grinstead; Hydrometallury. 12 (1984) pp. 387–400: Elsevier Science Publisher B.V., Amsterdam, (no month).

"Upgrading the U.S. Cobalt Stockpile Supply": by P.G. Bennet, J.V. Atwood, and L.D. Redden, (no date).

"Extractive Metallurgy of Nickel & Cobalt"; Edited by G.P. Tyroler and C.A. Landolt; a Publication of the Metallurgical Society, Inc.; pp 505–515, (no date).

"Experimental Production of High–Purity Cobalt" by K.K. Kershner, F.W. Hoertel, and J.C. Stahl; Reprinted from Bureau of Mines Report of Investigations 5175; Jan. 1956; pp. 1–12.

Japan Energy Website: "5N Co Target", http://sl.i–energy-.co.jp/job/material/target/monthly/08_Co.html, printed Jun. 30, 2000, 2 pgs.

* cited by examiner

METHOD FOR PROCESSING METALS

CROSS REFERENCE TO RELATED APPLICATION

This application is a divisional of U.S. patent application Ser. No. 09/608,709, which was filed on Jun. 30, 2000 and which is incorporated by reference herein.

FIELD OF INVENTION

The invention described herein relates to a method and apparatus for manufacturing metals, and also relates to the metals so produced. In a particular aspect, the invented process is utilized for producing cobalt, and comprises the dissolution and purification of solutions of $CoCl_2$ and/or $CoSO_4$, followed by further refining and deposition by electrolysis. The electrolysis can be followed by vacuum melting to produce further refined cobalt. The cobalt produced is preferably "high-purity" cobalt, with high-purity cobalt according to this invention being defined as having a total metallic purity of 99.99% (4N) or greater, excluding gaseous impurities. The high-purity cobalt produced is suitable for use in sputter targets and related microelectronic applications. The cobalt material can also be lower purity in cobalt, such as, for example, cobalt materials that are about 99.9% cobalt.

BACKGROUND OF THE INVENTION

High-purity metals are desired for many modern processes, such as, for example, as solders, sputtering targets, and applications in semiconductor devices. For instance, high purity cobalt can be desired for formation of sputtering targets. In particular applications, a film of cobalt is sputter-deposited from a high-purity target, and onto a silicon substrate. The film is then subjected to a heat treatment to form cobalt disilicide ($CoSi_2$). Cobalt disilicide has low resistivity and low formation temperature, and is considered a good alternative to titanium disilicide ($TiSi_2$) in integrated circuit applications. It is thus possible that cobalt will partly replace titanium in the manufacture of new generation chips. Cobalt sputtering techniques can also be applied to the manufacture of data storage devices, flat panels and other similar products. Considering the rapid development of the electronics industry, it is believed that a potential market exists for cobalt targets of a purity of 4N or greater.

Cobalt is recovered as a co-product of copper in Central Africa, and as a by-product of hydrometallurgical refining of nickel elsewhere. In the African plants, copper-cobalt concentrates are roasted and leached in a sulfuric acid solution. Copper and cobalt are recovered separately from the leach solution by direct electrowinning. For hydrometallurgical refining of nickel, a variety of techniques such as selective precipitation and crystallization, solvent extraction and ion exchange, are used to separate cobalt from nickel. Cobalt is then electrowon from sulfate or chloride solutions. In addition to the electrowinning process, cobalt can also be produced as metal powder using a soluble cobaltic amine process. Nickel, as a sister element to cobalt, is always found in cobalt produced by these processes. Other impurities in the resulting cobalt include alkali metals (such as Na, K), radioactive elements (such as U, Th), transition metals (such as Ti, Cr, Cu, Fe) and gaseous impurities (with gaseous impurities being those measured by LECO, and being O, C, S, N, H).

Nickel is not easily removed from cobalt. This is because of the similarity of cobalt and nickel in a series of properties.

Cobalt and nickel can form thermodynamically ideal liquid and solid solutions. The solidification of a Co—Ni system takes place in a temperature interval of only a few degrees. The standard electrode potentials of the reactions $$Co^{2+}+2e-\rightarrow Co;$$

and $$Ni^{2+}+2e-\rightarrow Ni$$

in aqueous solutions at 25° C. are −0.28V and −0.23V, respectively. The difference of both potentials is only 0.05V. All of these factors make the separation of cobalt and nickel very difficult.

For the semiconductor industry, it can be important to minimize impurities in cobalt sputtering targets in order to prevent problems with semiconductor chips comprising sputter-deposited cobalt. Specifically, alkali metals (such as Na and K), non-metallics (such as S and C), and metallics (such as P within the context of this document) are undesirable because these elements are considered to be very mobile and may migrate from one semiconductor device layer to another. Fe is another element that can be undesirable. Specifically, Fe can affect the magnetic properties of a material, which causes concern for magnetic inconsistency. Further, Fe, as well as Ti, Cr, Cu can be undesirable in that they can cause problems with connections at semiconductor device interfaces. Additionally, gaseous impurities (such as oxygen) are undesirable since they can increase electrical resistivity of the cobalt and the cobalt silicide layer in semiconductor devices. Increasing 0 levels also increase particulates that form during application of metallization layers. These particulates can degrade or destroy a cobalt silicide layer. Ni impurities in cobalt are undesired since Ni can influence the pass-through flux of cobalt sputtering targets. And finally, radioactive elements such as U and Th are undesirable in Co since they emit alpha radiation, which can cause semiconductor device failures.

Other metals, besides cobalt, also have applications as high-purity materials (for instance as sputtering targets or as solders), and it would be desirable to develop purification methods which can be applied not only to cobalt, but also to other metals.

SUMMARY OF THE INVENTION

In accordance with the present invention there is provided a method and apparatus for producing high-purity metals. The invention also encompasses the high-purity metals which can be produced by the method and apparatus. In one aspect, the method is a combination of electrolysis and ion exchange followed by vacuum melting to produce cobalt of a desired purity. Specifically, a method of the present invention can comprise the following steps:

(a) Providing an electrolysis cell;

(b) Anodically dissolving cobalt metal into an electrolyte solution;

(c) Passing impure electrolyte solution at controlled pH and flow rate across a chelating ion exchange resin to remove contaminates and form a cleaned electrolyte solution; and (d) Transferring the cleaned electrolyte solution to the cell and cathodically depositing purified metal at a cathode of the cell.

Methodology of the present invention can produce high-purity metal with minimum elemental impurities, and can be used, for example, in the formation of high-purity cobalt.

The high-purity cobalt so produced is at least 99.99% cobalt, and in particular embodiments can comprise 99.9995% cobalt. The high purity cobalt can have total impurities (excluding gasses) of less than 100 ppm, and in particular embodiments can comprise total metallic impurities of less than 25 ppm, with total metallic impurities being defined as the sum of the elemental impurities Li, Be, B, Na, Mg, Al, Si, P, K, Ca, Sc, Ti, V, Cr, Mn, Fe, Co, Ni, Cu, Zn, Ga, Ge, As, Se, Br, Rb, Sr, Y, Zr, Nb, Mo, Ru, Rh, Pd, Ag, Cd, In Sn, Sb, Te, I, Cs, Ba, La, Ce, Pr, Nd, Sm, Eu, Gd, Tb, Dy, Ho, Er, Tm, Yb, Lu, Hf, Ta, W, Re, Os, Ir, Pt, Au, Hg, Tl; Pb, Bi, Th, U, Cl and F (not including those at detection limits). It is noted that for purposes of interpreting this disclosure and the claims that follow, some elements are listed as "metallic impurities", even though the elements are not typically considered metals. Such elements are B, Si, P, As, Se, and Br.

Individual elemental impurities of cobalt produced in accordance with the present invention can be as follows: Na and K less than 0.5 ppm each, Fe less than 10 ppm (and in particular embodiments less than 8 ppm), Ni less than 5 ppm (and in particular embodiments less than 3 ppm), Cr less than 2 ppm (in particular embodiments less than 1 ppm, and in some embodiments less than 0.01 ppm), Ti less than 3 ppm (in particular embodiments less than 1 ppm, and in some embodiments less than 0.4 ppm), and O less than 450 ppm (and in particular embodiments less than 100 ppm). The method of chemical analysis used to determine the metallic impurities set forth herein is glow discharge mass spectroscopy (GDMS) and the method used to determine gaseous impurities is LECO, unless otherwise specified.

DETAILED DESCRIPTION OF THE INVENTION

Figure 1:
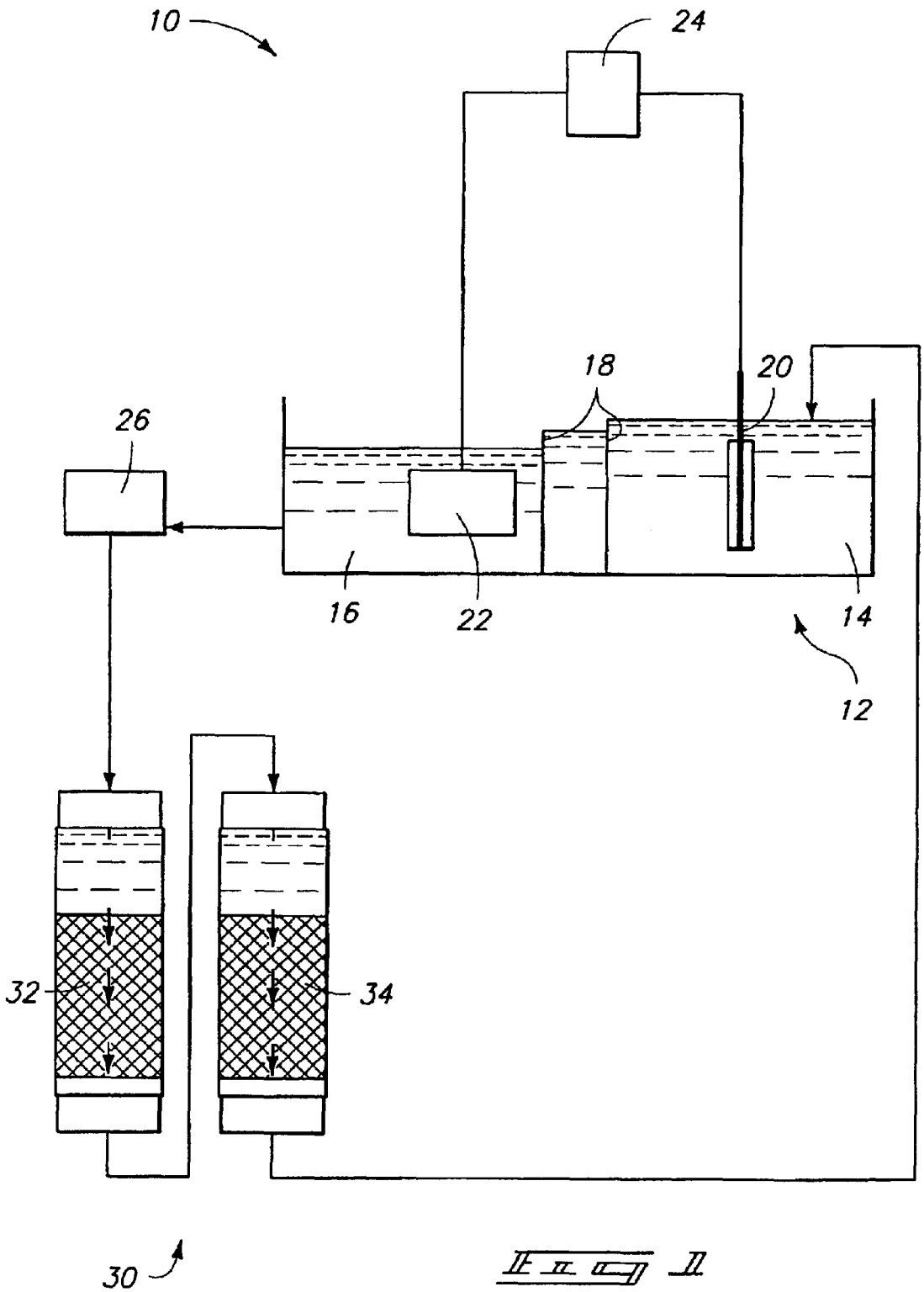
FIG. 1 is a schematic diagram of an apparatus which can be utilized in methodology of the present invention.

The invention is described with reference to an exemplary process for formation of high-purity cobalt, but it is to be understood that the invention can also be utilized for purification of metals other than cobalt.

In the exemplary process of forming high-purity cobalt, the invention can comprise the use of a purified $CoCl_2$ and/or $CoSO_4$ solution as a catholyte. Both $CoCl_2$ and $CoSO_4$ have proved successful in the production of high-purity cobalt as defined by this invention. However, $CoCl_2$ solutions can generate corrosive HCl vapors during an electrolytic process that can cause severe corrosion to equipment, which in turn can be a source of contamination in cobalt produced by the electrolysis. Therefore, to alleviate undesirable corrosion of equipment and ultimate contamination of produced cobalt, it can be preferable to use the less corrosive $CoSO_4$ in practice. Alternatively, a combination of $CoCl_2/CoSO_4$ can be used as the catholyte. An advantage of including $CoCl_2$, in addition to $CoSO_4$, is that the $CoCl_2$ has a better conductivity than $CoSO_4$.

An exemplary purification system of the present invention is described with reference to an apparatus 10 of FIG. 1. A cobalt sulfate and/or cobalt chloride solution is transferred to an electrolysis cell 12 that is divided into a cathode compartment 14 and an anode compartment 16 by one or more anionic exchange membranes 18 (a suitable anionic exchange membrane is an acrylic membrane known by the trademark 204-UZRA-412). The membranes provide a barrier to prevent cations of metals such as cobalt, iron, nickel and copper from crossing over while at the same time allowing anions (such as $SO_4^{2-}$ and $Cl^{31}$) to cross freely.

At least one cathode 20 is provided in cathode compartment 14, and at least one anode 22 is provided in anode compartment 16. A power source 24 is electrically connected with cathode 20 and anode 22 to form part of an electrical circuit. Membranes 18 allow ionic conduction between the anode and cathode to complete the electrical circuit without letting contaminates from the impure anode (such as Fe, Ni and Cu cations) pass. For purposes of interpreting this disclosure and the claims that follow, the solution within cell 12 is defined to be an electrolyte solution, with the anions and cations that are present in the solution being defined to be electrolytes. At least one pump 26 is provided, and the impurity cations along with the cobalt ions of the electrolyte are pumped from anode compartment 16 of cell 12 as sulfates and/or chlorides, and through an external ion exchange resin system 30. The solution exiting system 30 is returned to cell 12, and specifically is flowed into cathode compartment 14.

Although only one pump is shown in the exemplary apparatus 10, it is to be understood that additional pumps could be provided. Also, although only one ion exchange resin system is shown, it is to be understood that additional ion exchange resin systems could be provided.

Ion exchange resin system 30 comprises a first exchange column 32 and a second exchange column 34. The two exchange columns 32 and 34 can be identical to one another. A reason for utilizing two exchange columns, instead of one longer column, can be to allow design flexibility relative to utilization of space. It is to be understood that although two exchange columns are shown, the invention encompasses other embodiments (not shown) wherein only one exchange column is utilized, as well as other embodiments (not shown) wherein more than two exchange columns are utilized. Also, it is to be understood that columns 32 and 34 can be different than one another. For instance the columns can be different sizes than one another, or can be packed with different resins. Ion exchange resin system 30 comprises at least one ion exchange resin within at least one of columns 32 and 34. For purposes of interpreting this disclosure and the claims that follow, an ion exchange "resin" is defined as any material which supports ion-exchanging functional groups, and can include, for example, DOWEX™ beads.

The impure electrolyte solution comes in contact with the ion exchange resin and exchanges metal cations with $H^+$ ions in the exchange columns 32 and 34. This exchange can be dependent on temperature, pH and flow rate. A pH of between about 1 and about 3 can be preferred. The resin has a higher affinity for impurity ions of Cu, Ni and Fe than ions of Co. However, especially in the case of $Ni^{2+}$, the reaction kinetics can be much slower for some cations than others. To compensate for the slow kinetics, the solution can be run though the system warm to increase the reaction rate for $Ni^{2+}$. Temperatures between about 110° F. and about 130° F. can be preferable. The amount of time the solution contacts the resin can also be important. More reaction time can increase the displacement of $H^+$ and $Co^{2+}$ ions by $Ni^2$+ ions. Flow rates below 10 BV/Hr (BV/Hr: bed volume/hour), and more typically below about 1 BV/Hr are found to work well.

The solution exiting the ion exchange resin tank can be referred to as a "cleaned" electrolyte solution, to indicate that the relative concentration of cobalt to impurities is higher in the solution exiting the resin tank than it was in the solution entering the resin tank. As the cleaned electrolyte solution flows into the cathode compartment, it mixes with the catholyte. Also, some of the catholyte is leaked back to the anode compartment (over the membranes 18) to maintain compartment electrolyte volumes and maintain a continuous process. This leaking back can keep impurities from entering the catholyte.

The membranes of FIG. 1 are optional. Accordingly, although the shown embodiment comprises membranes 18, it is to be understood that the invention encompasses other embodiments (not shown) wherein there are no membranes utilized to split the cell into anode and cathode compartments. In particular embodiments, an appropriate balance is maintained between the rate of impurity removal through ion exchange, the rate of impurity addition through impure anode dissolution, and the system volume, so that there is little to no benefit in separating the electrolysis cell into anode and cathode chambers. In such embodiments, membranes 18 can be eliminated. The above-described appropriate balance can be accomplished by using enough resin to enable a flow rate through the ion exchange unit that is sufficient to offset any increase in impurity concentration in the bulk electrolyte solution caused by anodic dissolution of impure cobalt.

Eventually, the resin in the columns can become saturated with impurities. When such happens, the columns can be regenerated by disconnecting them from cell 12, flowing an acid (of pH preferably less than or equal to 1) through the columns, and subsequently flowing an acid (of pH preferably from about 1 to about 3) through the columns to bring the pH of the resin back up to that of the electrolyte solution. The columns can then be reconnected to cell 12.

The electrorefining step can electrolytically dissolve cobalt metal into solution in the anolyte (with the anolyte being defined as the electrolyte around the anode) and deposit it as high-purity cobalt from the purified catholyte (with the catholyte being defined as the electrolyte around the cathode). Although experiments have shown electrolytic refining of cobalt relative to both Ni and Fe, it can be desired to have the refining take place in the ion exchange system. This is because ion exchange enables removal of contaminates from the system when the resin is regenerated. In contrast, refining by electrolysis concentrates contaminants in the electrolyte.

An electrical system of apparatus 10 can comprise a DC power supply, an anode, cathode busbars, and a cathode. The cathode can be comprised of any electrically conductive material, such as, for example, cobalt or titanium Cobalt is the preferred choice for a cathode material since use of other materials (such as Ti) as the cathode material can increase impurities corresponding to the other materials in the final product.

Figure 2:
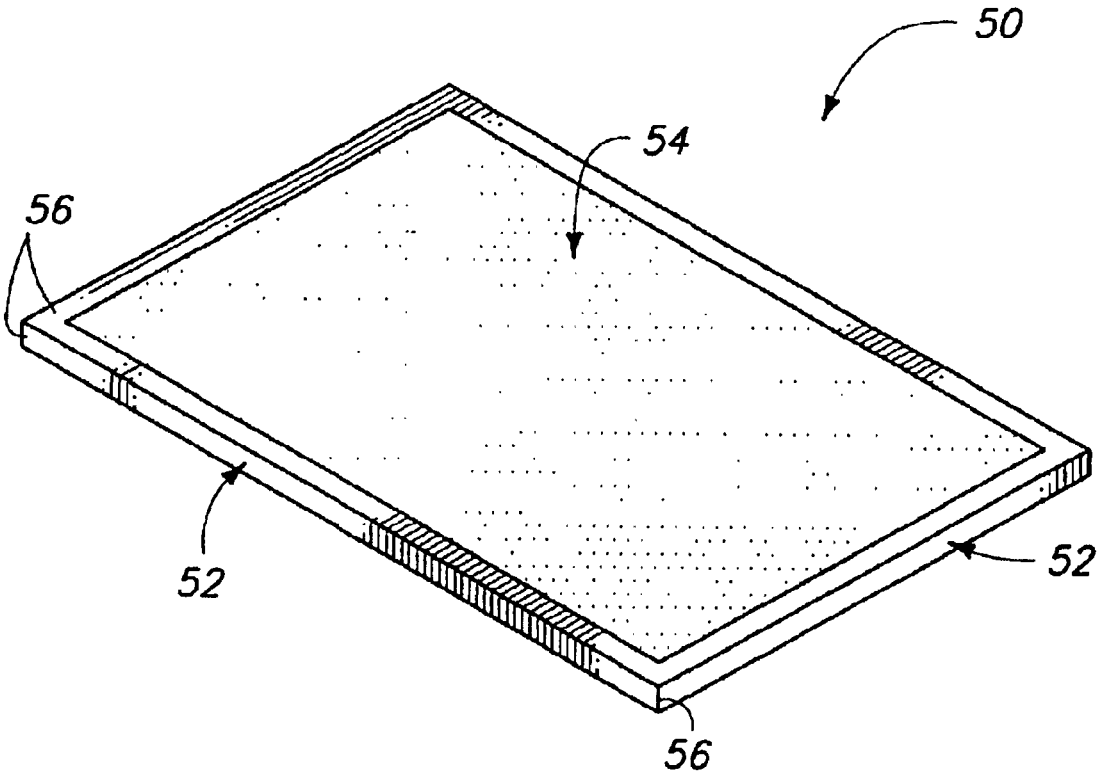
FIG. 2 is a diagrammatic, isometric view of a cathode that can be used in a method of the present invention.

In particular applications, the cathode will be at least one rectangular plate (actually, more of a foil than a plate, as the cathode is typically very thin) with dimensions of about 15" wide by about 18" to about 24" long, and from about 1/64" to about ½" thick. An exemplary cathode plate 50 is shown in FIG. 2. Plate 50 comprises vertical sidewalls 52 (there are four vertical sidewalls, but only 2 are visible in the view of FIG. 2), a top surface 54, and a bottom surface (not visible in the view of FIG. 2) in opposing relation to top surface 54. In operation, one or more of the top surface, bottom surface and sidewall surfaces are submerged in the electrolyte solution within chamber 14 (FIG. 1) during cathodic formation of cobalt on cathode 50. Ideally, top surface 54 is submerged in the electrolyte solution, and the cobalt metal deposited from the electrolyte solution forms a smooth film across surface 54. Due to high current density at the cathode corners and edges, non-smooth or dendritic deposits of cobalt can form at corners and edges of surface 54. Such problem can be alleviated by forming a non-conductive material over peripheral edges of surface 54, as well as over sidewalls 52. The non-conductive material preferably covers the outer ½" of surface 54, and is shown in FIG. 2 as a coating 56. Exemplary suitable materials for coating 56 are paint, rubber coatings, or chemical and heat resistant tape (such as a tape identified as AN™, and available from Canadian Finishing System, LTD., of Burlington, Ontario (Canada)).

Referring again to FIG. 1, impure cobalt metal (typically 3N5) is provided as anode 22, and is placed in one or more baskets made of a dimensionally stable anode material. Any material can be used for the baskets as long as it is dimensionally stable, or inert, as an anodic electrode under the described electrolysis conditions. An exemplary suitable material for the baskets is titanium with an iridium oxide coating.

An anode current density (ACD) can affect the dissolution efficiency of cobalt metal to $CoSO_4$. If the ACD is too high, side reactions have a higher tendency to take place. ACD can change greatly with depletion of anode cobalt and typically varies from about 10 $A/ft^2$ to 500 $A/ft^2$.

A cathode current density (CCD) can control the current efficiency and deposit characteristics of deposited cobalt. If the CCD is too high it will overcome the cobalt mobility in the electrolyte solution, which can make conditions more favorable for hydrogen production at the cathode. This will be visually apparent by pitting in the cathodic deposit. Although CCDs up to 50 $A/ft^2$ work well, CCDs of about 20 $A/ft^2$ are preferred.

Speed and efficiency of the electrorefining of the present invention can be dependent on several properties of the electrolyte solution, including pH, temperature and cobalt concentration. If the cobalt concentration of the solution is out of a desired range, the deposit quality and electrolysis efficiency will suffer. If the electrolyte solution pH drops below 1, hydrogen will start being reduced at the cathode at significant levels causing pitting of the deposit, and a lowering of the current efficiency of the system with respect to cobalt deposition. Accordingly, an electrolyte solution pH of above about 1 is desired for electrolysis. The electrolyte solution temperature can also influence reaction rates. Higher temperatures increase the mobility of ions in solution and allow higher reaction rates at the electrode to electrolyte interfaces. Electrolyte solution temperatures between about 110° F. and about 130° F., in combination with electrolyte solution pH's of from about 1.5 to about 2 have produced current efficiencies of up to about 95%.

After cobalt is formed on the cathode, it can be further processed by melting. If a low-purity cobalt or a titanium starter cathode is used, the high-purity cobalt deposit is preferably stripped from the starter cathode before melting. If the starter cathode is high-purity cobalt, it can be melted with the deposit. The methods of melting include, but are not limited to, inert atmosphere induction melting, vacuum induction melting and electron-beam melting. Electron-beam melting can be done by both drip and hearth melting.

Oxygen and carbon removal can occur in the melting step. Dissolved oxygen and carbon in the cathode materials react at melting temperatures to form CO gas. The CO gas is not soluble in the molten metal and escapes from the melt. Carbon in the final ingot is reduced to near depletion while the excess oxygen (that was present in the cathode cobalt) that is not consumed in the reaction remains dissolved in the ingot.

Typically, the cobalt deposited as a result of the above-described electrolysis/ion exchange process comprises between 100 and 1000 ppm oxygen. Two methods have been found to reduce the level of oxygen down to as low as about 14 ppm during a vacuum melting stage. The first involves adjusting the temperature and vacuum levels in the melt to make the conditions favorable to pull the oxygen from the melt. It is known that high vacuums will pull off volatile metallics such as Na and K upon melting. However, removal of oxygen can require that careful attention be paid to melt heating. The bond between cobalt and oxygen is not as stable as that of oxygen and other metals such as calcium, magnesium, aluminum, or titanium. The right combination of a strong enough vacuum and high enough temperature can be required in order to dramatically reduce oxygen content. Good results have been obtained in an electron beam furnace, and it should also work well in a vacuum induction furnace. It has been found that chamber vacuums better than around $5\times10^{31\ 5}$ atmospheres worked well in combination with the proper melt heating (an exemplary melt heating temperature is from about 1500° C. to about 2000° C.). In the electron beam furnace, melt heating is a function of electron beam power density. Melts that were exposed to similar vacuums produced lower oxygen cobalt at higher beam current densities. A reasonable range is between 1.5 and 5 KVA/in$^2$.

The second method for reducing oxygen in the final product is by mixing fine carbon powder with the melt stock. This is done to compensate for the excess oxygen, with respect to carbon, in the high-purity cathode cobalt material. A suitable amount of carbon is that which will bring the oxygen:carbon ratio to about 1:1 on an atomic basis. This amount can be calculated. The cathode chemistry is generally consistent throughout one lot of material, so the calculation can be based on one representative analysis of oxygen and carbon in the cathode.

It is noted that previous methods for refinement of cobalt have utilized ion exchange in combination with electrolysis. For instance, U.S. Pat. No. 5,667,665 describes a process wherein an electrolyte from a cobalt refinement electrolysis process is subjected to purification which includes utilization of an anion exchange resin to separate cobalt from impurities. The patent further describes that the cobalt is returned to the electrolysis process after the purification. The previous methods differed from the method of the present invention. The previous methods involved placing the cobalt from the electrolyte in a first solution from which the cobalt was loaded onto an anion exchange resin. The cobalt was retained on the resin, and then subsequently eluted with a second solution which was different from the first solution. The present invention involves passing the electrolyte solution from an electrolysis cell through an anion exchange resin under conditions in which a desired metal (such as cobalt) is not retained on the resin, but instead passes through the resin to leave impurities retained on the resin. The metal can then be returned to the electrolysis cell after passing through the resin. The present invention can thus be more readily adapted to continuous purification of metals than could previous processes, in that the present invention reduces the two-step batch-type anion exchange purification of the previous process (the two steps being loading of a metal of interest on an ion exchange resin, and elution of the metal of interest from the resin), to a single step continuous process (the single step being passage of a metal of interest through an ion exchange resin).

Among the advantages of the method of the present invention relative to the prior art processes exemplified by U.S. Pat. No. 5,667,665 are:

(a) the process of the present invention can eliminate an anolyte dilution step that can occur in prior art processes prior to loading anolyte onto an ion exchange resin; and (b) the process of the present invention can eliminate a concentration step of the prior art processes in which a cobalt salt was concentrated (or even dried) after elution from a resin and then dissolved in water prior to its use as an electrolyte.

EXAMPLES

The invention is illustrated by, but not limited to, the following examples.

Example 1

Electrolytic Formation of Cobalt

A sample of 1472 lbs of $CoSO_4.7H_2O$ is dissolved into 370 gallons of water at room temperature while stirring. Again while stirring, the pH of the cobalt sulfate solution is adjusted to 2 by adding 2.44 gallons of 98% sulfuric acid, ACS grade. The solution is added to a divided electrolysis tank and heated to 122° F. Circulation is started to the ion exchange tanks, which contain 5 cubic feet of resin, and a flow through the tanks is at a rate of 0.5 GPM. The cobalt sulfate solution is analyzed and found to contain 80 to 90 g/L Co, 3 to 4 mg/L Fe, and 1 to 2 mg/L Ni, and the pH is 2. Electrolysis is run at constant current of 300A and the voltage observed to fall from 9V to 5V over the 216 hour run. Cathodes are 99.95% Co sheet, and run at a current density of 18 A/ft$^2$. About 116 lbs of cobalt is harvested, which relates to a cathodic current efficiency of 74%. The analysis of the deposit is shown in Table 1 as the "high purity cathode". Also shown in Table 1 are analysis values obtained after additional treatments of the "high purity cathode" material. The additional treatments were either vacuum induction melting, electron beam drip melting or electron beam hearth melting. The additional treatments reduce gaseous impurities (specifically, the treatments reduce concentrations of C, S, O and N).

TABLE 1

| Element | High Purity Cathode (ppm) | Vacuum Induction Melt (ppm) | Electron Beam Drip (ppm) | Electron Beam Hearth (ppm) |
|---|---|---|---|---|
| Na | 0.26 | <0.01 | <0.01 | 0.04 |
| Al | 0.0024 | 0.11 | 0.1 | 0.15 |
| Si | 0.0017 | 1 | 0.01 | 0.03 |
| K | 0.013 | <0.01 | <0.01 | <0.01 |
| Ti | 0.033 | 0.06 | 0.14 | 0.31 |
| Cr | 0.0050 | 0.25 | 0.29 | 0.93 |
| Mn | <0.00047 | 0.15 | 0.02 | 0.01 |
| Fe | 7.9 | 11 | 7.5 | 9.3 |
| Ni | 2.0 | 2.5 | 2 | 3.9 |
| Cu | 0.0091 | 0.08 | 0.65 | 0.42 |
| Zn | 2.0 | <0.1 | <0.1 | <0.1 |
| Mo | 0.043 | 0.03 | 0.07 | 0.05 |
| W | 0.0020 | <0.01 | 0.2 | <0.01 |
| Th (ppb) | <0.072 | <1 | <1 | <1 |
| U (ppb) | <0.086 | <1 | <1 | <1 |
| Pb | 0.091 | <0.01 | <0.01 | <0.01 |
| C | 223 | 5 | 3 | 6 |
| O | 407 | 41 | 14 | 62 |
| N | 41 | <1 | 1 | 1 |

TABLE 1-continued

| Element | High Purity Cathode (ppm) | Vacuum Induction Melt (ppm) | Electron Beam Drip (ppm) | Electron Beam Hearth (ppm) |
|---|---|---|---|---|
| P | 0.06 | | | |
| S | 8.7 | 6 | <1 | 6 |
| Total metallic purity | 99.998% | 99.998% | 99.996% | 99.998% |

Example 2

$CoCl_2$ System

Cobalt powder of a purity 3N8 (99.98%), Powder A, and 2N7 (99.7%), Powder B, is dissolved in HCl (35–38%, by weight, in water). The solution is then heated to about 80° C., while stirring, for about 10 hours. Solid $CoCl_2.6H_2O$ is dissolved by adding 2 liters of deionized water and stirring at about 50° C. for about 8 hours. More deionized water is then added to get a final solution volume of about 5 liters.

A plastic tube of 0.953 cm inside diameter and 120 cm length, connected on one end with a reducer, is used as an ion exchange column. Glass wool is used as screen material. The tube is filled with about 42.6 ml Dowex M-4195 anion exchange resin, with an average size of 20–50 mesh. Prior to loading, the resin is conditioned by passing 2 bed volumes (BV) of HCl solution through it at a flow rate of about 15 BV/Hr. The pH value of the HCl solution is the same as that of the feed solution. A typical experiment comprises (1) loading the resin by pumping cobalt chloride solution through the resin bed; and (2) eluting the loaded resin bed with HCl acid solution. A two-step eluting is normally conducted: The first step uses a solution of lower acidity to elute cobalt, whereas a stronger acid solution is used for the second step to elute nickel. Although this example describes a batch elution process, it is noted that one or more aspects of the example can also be incorporated into a single step (i.e., non-batch) elution process of the present invention wherein cobalt passes through the ion exchange resin without being loaded and eluted with separate solutions.

An organic solution comprising 20 vol. % Cyanex 272 mixed with 80 vol. % toluene is prepared and utilized for extraction and purification of cobalt. An aqueous to organic (A/O) ratio of 1 was used for both loading and stripping. Impure cobalt chloride solution, or solution treated by ion exchange, is used as a feed solution for loading. An HCl solution, diluted with deionized water, of pH about 0.2, is used for stripping. A magnetic heating plate is used to provide both heating and stirring. A NaOH solution is used to adjust the pH of the impure cobalt chloride solution to about 2 for loading. After the desired pH value is reached, the mixture of cobalt chloride solution and organic solution is stirred for an additional 10 min. For stripping, the loaded organic solution is mixed with stripping solution for 10 minutes. After settlement of 10 min, samples of each phase are obtained for assay.

The above-described organic extraction can separate cobalt from other impurities of the impure cobalt solution. Specifically, the cobalt will migrate from the aqueous phase of the impure cobalt solution to the organic phase when the aqueous phase is pH 2, and will then migrate from the organic phase to the aqueous stripping solution when the stripping solution is pH 0.2. Impurities present in the impure cobalt solution will typically not migrate back and forth to the organic solution with the cobalt.

The electrolysis cell is placed inside a water bath to keep a bout a constant temperature. Cobalt chloride solution, purified by either ion exchange or solvent extraction or both, is introduced into the cathodic and membrane compartments, and the anodic compartment contains untreated impure cobalt chloride solution. The membrane used in this experiment is an acrylic membrane known by the trademark 204-UZRA-412. A piece of impure cobalt with a purity of 2N8 is used as the anode, and the cathode is made of high-purity titanium plate. After pH adjustment of both anolyte and catholyte to pH 1.5, electrolysis is conducted at a constant current density utilizing a temperature of 50° C., and a current density of $200A/m^2$. Table 2 shows the major impurities (in ppm) for cobalt after processing by electrolysis and ion exchange, using Powder A as the starting material.

TABLE 2

| Element | Powder A | After Ion Exchange Treatments |
|---|---|---|
| Mg | 12 | 0.04 |
| Al | 2.2 | 0.36 |
| Ti | 2 | 1.1 |
| V | 0.13 | 0.005 |
| Cr | 16 | 2.8 |
| Mn | 35 | 0.004 |
| Fe | 20 | 2.2 |
| Ni | 21 | 2.3 |
| Cu | 3.5 | 1.8 |
| Zn | 30 | 16 |
| Zr | 0.15 | 0.03 |
| Nb | 0.95 | 0.05 |
| Mo | 4.5 | 4.7 |
| W | <0.01 | 0.09 |
| Pb | 0.31 | 2.2 |
| Sum | 147.75 | 33.68 |
| Purity (%) | 99.985225 | 99.996632 |

Table 3 shows a tabulation of metallic purity, and of major impurities (in ppm), for different cobalt samples (Experiment starting with powder A). Foil 1 corresponds to a cathode cobalt sample made using solution treated one time by solvent extraction, and foil 2 corresponds to a cathode cobalt sample made using solution treated 1 time by solvent extraction and 4 times by ion exchange.

TABLE 3

| Element | Foil 1 | Foil 2 |
|---|---|---|
| Mg | 0.45 | 0.41 |
| Al | 1.7 | 0.79 |
| Ti | 5 | 9 |
| V | 0.007 | <0.001 |
| Cr | 1.4 | 1.4 |
| Mn | 0.09 | 0.61 |
| Fe | 2.7 | 1.2 |
| Ni | 3.2 | 1.9 |
| Cu | 42 | 0.14 |
| Zn | 45 | 5.5 |
| Zr | 0.15 | 0.03 |
| Nb | <0.005 | <0.005 |
| Mo | 0.1 | 0.15 |
| W | 0.02 | 0.38 |
| Pb | 1.5 | 1.5 |
| Sum | 103.32 | 23.02 |
| Purity (%) | 99.989668 | 99.997698 |

Table 4 shows a tabulation of metallic purity, and of major impurities (in ppm), for a cobalt sample (Experiment starting with powder B). The cobalt sample was made using solution treated 1 time by solvent extraction and 5 times by ion exchange.

TABLE 4

| Element | Powder B | Cobalt Sample |
|---|---|---|
| Mg | 250 | 0.06 |
| Al | 130 | 0.2 |
| Ti | 5.8 | 5 |
| V | 0.46 | <0.001 |
| Cr | 98 | 0.1 |
| Mn | 60 | 0.01 |
| Fe | 600 | 28 |
| Ni | 760 | 4 |
| Cu | 13 | 1 |
| Zn | 20 | 0.4 |
| Zr | 0.1 | 0.02 |
| Nb | 0.05 | 0.008 |
| Mo | 16 | 0.3 |
| W | 0.53 | 0.06 |
| Pb | 19 | 10 |
| Sum | 1972.94 | 49.16 |
| Purity (%) | 99.802706 | 99.995084 |

Example 3

Fe-removal

Fe can be a major impurity element in cobalt. Like Ni, it can influence the pass-through flux of cobalt sputtering targets, and accordingly is preferably minimized. Although the resin used in the invention has the capability to absorb a certain amount of Fe, additional Fe removal steps are desired when Fe content in the raw cobalt is high. Different methods can be used for Fe removal: 1) $Fe(OH)_3$ precipitation; 2) solvent extraction; and 3) an additional selective ion exchange; etc. In a particular embodiment, this invention has successfully integrated $Fe(OH)_3$ precipitation into the cobalt refining process to handle excessive Fe impurities.

For $Fe(OH)_3$ precipitation, air or oxygen gas is blown into the impure $CoSO_4$ or $CoCl_2$ solution during stirring for a certain time to oxidize the $Fe^{2+}$ ions to $Fe^{3+}$ ions. NaOH is then added to the $CoSO_4$ or $CoCl_2$ solution to change its pH to about 4. $Fe(OH)_3$ crystallizes at such pH because of its low solubility. After most of the $Fe(OH)_3$ has settled, the solid $Fe(OH)_3$ particles are separated from the $CoSO_4$ or $CoCl_2$ solution by filtration.

In an exemplary embodiment, cobalt powder of purity 2N7 is dissolved in $H_2SO_4$ (98%) diluted with 50 vol. % deionized water. Heating and stirring are provided to accelerate dissolution. Typically, 2 liters of $H_2SO_4$ solution are placed in a 5 liter beaker, and 500 g cobalt powder is slowly stirred into the acid solution. The solution is heated to about 80° C., while stirring for about 10 hours. Afterwards, more deionized water is added to reach a cobalt concentration of about 100 g/l.

Two equal volumes of the prepared solution, referred here to as volume A and volume B, are taken to make two cathode cobalt samples A and B, respectively. Volume A is treated by ion exchange alone and used for electrolysis to make sample A.

Volume B is treated as follows:

air is blown into volume B during stirring for about 1 hour to oxidize the $Fe^{2+}$ ions to $Fe^{3+}$ ions;

NaOH Is added to the solution to change its pH to about 4 ($Fe(OH)_3$ crystallizes at such pH);

after settling for about 1 hour, the solid $Fe(OH)_3$ particles are separated from the CoSO4 solution by filtration; and subsequent ion exchange and electrolysis are conducted the same way as discussed above relative to volume A.

GDMS data for sample B is listed in Table 5 for a direct comparison to starting powder. More specifically, Table 5 shows purity (unit: %) and major impurities (unit: ppm) for cobalt powder used as raw material for preparing a cobalt solution.

TABLE 5

| Element | Powder | Sample B |
|---|---|---|
| Mg | 250 | 1.3 |
| Al | 130 | 2.1 |
| Cr | 98 | 0.3 |
| Mn | 60 | 0.02 |
| Fe | 600 | 32 |
| Ni | 760 | 12 |
| Cu | 13 | 0.54 |
| Mo | 16 | 0.36 |
| Purity (%) | 99.802706 | 99.994 |

Sample B shows a much lower Fe content, verifying that $Fe(OH)_3$ precipitation can be effective for reducing Fe impurities.

In compliance with the stature, this invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method for purifying a metal, comprising:

providing an electrolysis cell having an anode and a cathode, the anode comprising the metal that is to be purified;

anodically dissolving the metal from the anode into an electrolyte solution as a metal ion electrolyte;

after the dissolving, passing at least some of said electrolyte solution across an ion exchange resin to reduce a concentration of one or more impurities in the electrolyte solution relative to a concentration of the metal ion in the electrolyte solution, the ion exchange resin having a bed volume, the electrolyte being passed across the resin at a flow rate of greater than 0 BV/Hr and less than or equal to about 10 BV/Hr under conditions in which the metal ion is not loaded on the resin but instead flows across the resin, and in which one or more impurities are retained on the resin;

after passing the at least some of the electrolyte solution across the resin, transferring said electrolyte back to said electrolysis cell and cathodically depositing the metal from the metal ion of the electrolyte at the cathode; and wherein the cathode has a surface exposed to the electrolyte during the cathodically depositing, and further comprising forming a non-conductive material around a periphery of the surface before the cathodically depositing.

2. The method of claim 1 wherein the resin is in the form of a bed of ion-exchanging material packed within at least one column.

3. The method of claim 1 wherein the resin is in the form of a bed of anion-exchanging material packed within at least one column.

4. The method of claim 1 wherein the cell comprises an anode compartment separated from a cathode compartment by a membrane.

5. The method of claim 4 further comprising a continuous flow of the electrolyte solution from the anode compartment, across the ion exchange resin, and into the cathode compartment during the anodically dissolving and cathodically depositing.

6. The method of claim 1 wherein the metal is cobalt.

7. The method of claim 6, wherein said electrolysis cell is separated into an anode chamber and a cathode chamber with an anionic exchange membrane.

8. The method of claim 6 wherein the electrolyte solution comprises one or both of $CL^-$ and $SO_4^{2-}$.

9. The method of claim 6 wherein the anode current density during the anodically dissolving is from about 10 $A/ft^2$ to about 500 $A/ft^2$.

10. The method of claim 6 wherein the cathode current density during the cathodically depositing is from greater than 0 $A/ft^2$ to about 50 $A/ft^2$.

11. The method of claim 6 wherein the cathode current density during the cathodically depositing is from greater than 0 $A/ft^2$ to about 20 $A/ft^2$.

12. The method of claim 6 wherein the electrolyte is passed through the ion exchange resin at a flow rate of greater than 0 BV/Hr, and less than or equal to about 1 BV/Hr.

13. The method of claim 6 further comprising, after the passing said electrolyte solution across an ion exchange resin and before the cathodically depositing:

extracting cobalt electrolyte from the electrolyte solution by extraction of the cobalt electrolyte into an organic solvent;

extracting of the cobalt electrolyte from the organic solvent and into an aqueous solution; and transferring the cobalt electrolyte to the electrolysis cell.

14. The method of claim 6 further comprising, prior to passing the electrolyte through the ion exchange resin, removing Fe from the electrolyte solution.

15. The method of claim 6 further comprising, prior to passing the electrolyte through the ion exchange resin, precipitating Fe from the electrolyte solution.

16. The method of claim 6 further comprising, after passing the electrolyte through the ion exchange resin and before cathodically depositing cobalt, removing Fe from the electrolyte solution.

17. The method of claim 6 further comprising, after passing the electrolyte through the ion exchange resin and before cathodically depositing cobalt, precipitating Fe from the electrolyte solution.

* * * * *